United States Patent [19]

Etherington et al.

[11] 4,150,603

[45] Apr. 24, 1979

[54] FLUID OPERABLE HAMMER

[75] Inventors: Murray D. Etherington, Aurora, Colo.; David V. Roberts, Waterloo, Canada

[73] Assignee: Joy Manufacturing Company, Pittsburgh, Pa.

[21] Appl. No.: 830,557

[22] Filed: Sep. 6, 1977

[51] Int. Cl.[2] ..... F01L 15/02

[52] U.S. Cl. ..... 91/50; 91/321; 60/371

[58] Field of Search ..... 60/369, 371, 414; 91/4, 91/218, 281, 301, 303, 321, 50, 307

[56] References Cited

U.S. PATENT DOCUMENTS

| | | | |
|---|---|---|---|
| Re. 27,244 | 12/1971 | Voitsekhovsky et al. | 91/290 |
| 3,079,900 | 3/1963 | Hunnicutt | 60/407 X |
| 3,735,823 | 5/1973 | Terada | 173/119 |
| 3,872,934 | 3/1975 | Terada | 173/134 |
| 4,012,909 | 3/1977 | Hibbard | 60/371 |

*Primary Examiner*—Edgar W. Geoghegan
*Attorney, Agent, or Firm*—J. Stewart Brams

[57] ABSTRACT

A fluid operable hammer including variable volume exhaust fluid receiving chamber means cooperable with improved motive fluid inlet and exhaust valve means.

22 Claims, 3 Drawing Figures

FLUID OPERABLE HAMMER

In the art of fluid operable hammers or impactors it is known to provide fluid power means for reciprocably cycling a hammer piston to produce repetitive impacts on a working member. For example in U.S. Pat. No. 4,012,909 there is described an impactor including a gas pressure motive means which continuously applies gas pressure to one end of an axially movably disposed hammer piston and hydraulic fluid pressure means for applying fluid pressure to the opposite end of the hammer piston to "cock" or upstroke the piston against the continuously applied gas pressure. After each such piston upstroke the hydraulic fluid pressure is released to exhaust whereupon the piston is driven by the continuously applied gas pressure through its downstroke or power stroke to deliver an impact blow to a working member.

Although such impactors have generally served their intended purposes they have nevertheless often been subject to certain deficiencies. For example in order to minimize hydraulic fluid back pressure which impedes hammer piston movement through its power stroke and thereby reduces the available impact energy, such impactors have often been provided with an exhaust fluid receiving means including a chamber located directly adjacent the hammer piston bore and maintained in open, substantially unrestricted fluid flow communication therewith during the piston impact stroke to facilitate the exhausting of hydraulic fluid therefrom. External suction pump means have typically been associated with the fluid receiving exhaust chamber to drain the hydraulic fluid therefrom prior to each piston power stroke thus providing space within the chamber to receive the hydraulic fluid to be exhausted during the next piston power stroke. Without such pump means the exhaust chamber would remain substantially full of hydraulic fluid and the benefits thereof (e.g. exhaust back pressure reduction) would be lost. Desirable as such exhaust fluid receiving means have been in the prior art they have nevertheless contributed to unnecessarily complex impactor design and unduly limited impactor utility. For example, the location of the exhaust chamber fluid outlet port which communicates with the suction pump means has limited the available operating positions or orientations of prior impactors inasmuch as the outlet port must be in continuous fluid flow communication with the fluid within the exhaust chamber to permit proper suction pump operation.

The present invention alleviates these and other shortcomings of the prior art by providing an impactor having improved exhaust fluid receiving means including a main exhaust valve means which selectively controls fluid communication between the hammer piston and a variable volume exhaust fluid receiving chamber. Also, the exhaust fluid receiving chamber cooperates with the main exhaust valve to provide a pumping action for pumping hydraulic fluid out of the exhaust chamber prior to each power stroke of the piston. By virtue of this invention the impactor is fully operative regardless of the physical orientation thereof.

These and other objects and advantages of the instant invention are more fully specified in the following description with reference to the accompanying figures in which.

Figure 1:
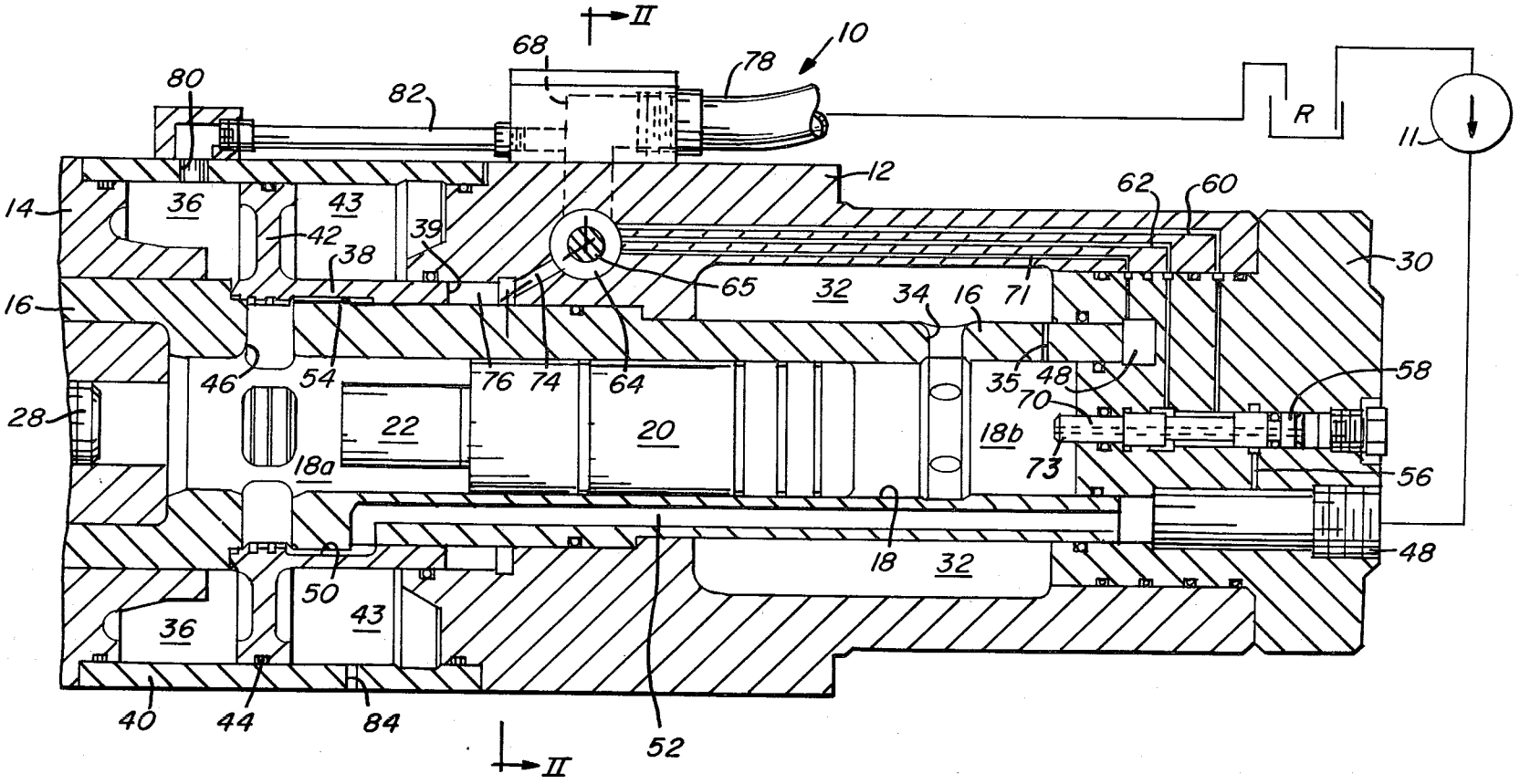
FIG. 1 is a longitudinal section of a portion of an impactor taken on line 1—1 of FIG. 2 and showing exhaust fluid receiving means according to one embodiment of the instant invention.

There is generally indicated at 10 in FIG. 1 a rearward end portion of a fluid operable impactor or hammer constructed according to one embodiment of the instant invention. Impactor 10 comprises a generally annular, elongated rear body portion 12 coaxially aligned with a generally annular, elongated forward body portion 14. A main cylinder member 16 extends coaxially within body portions 12 and 14 and includes a stepped coaxial through bore 18 within which there is axially reciprocably carried an elongated hammer piston 20. Piston 20 divides bore 18 into forward and rearward bore portions **18*a*, 18*b*, respectively. An elongated, coaxially forwardly projecting stem portion 22 of piston 20 is adapted to deliver impact blows to a striking bar 28 carried by body portion 14 upon axial reciprocation of piston 20 within bore 18 as is well known. In FIG. 1 piston 20** is shown at an intermediate position between the impact point and the full upstroke position.

A backhead member 30 is rigidly sealingly secured adjacent an axially rearward end portion of body portion 12 and cylinder 16 for sealed closure of bore portion 18b and to define in conjunction with body portion 12 and cylinder 16 a generally annular, elongated gas accumulator space 32 located radially intermediate body portion 12 and cylinder 16. A plurality of circumferentially spaced radially extending bores 34, 35 penetrate cylinder 16 to provide fluid communication between accumulator space 32 and bore portion 18b. In practice the space comprised of bore portion 18b, accumulator space 32 and interconnecting bores 34, 35 is charged with motive fluid under pressure, for example nitrogen at approximately 1200 psi, which acts on the rearward end of piston 20 to continuously urge the piston forward toward striking bar 28. For reciprocation of piston 20 hydraulic fluid pressure is alternately applied to the forward end of piston 20 to move piston 20 toward its rearward or upstroke position against the bias of the pressurized gas charge within accumulator 32. After each piston upstroke the applied hydraulic fluid pressure is relieved to exhaust and the accumulator gas pressure drives piston 20 to impact on striking bar 28.

Inasmuch as the components and mode of operation of impactor 10 insofar as described hereinabove are substantially the same as described in the cited U. S. patent further detailed description thereof is deemed unnecessary. Reference to the cited patent may be had for further such description.

Figure 3:
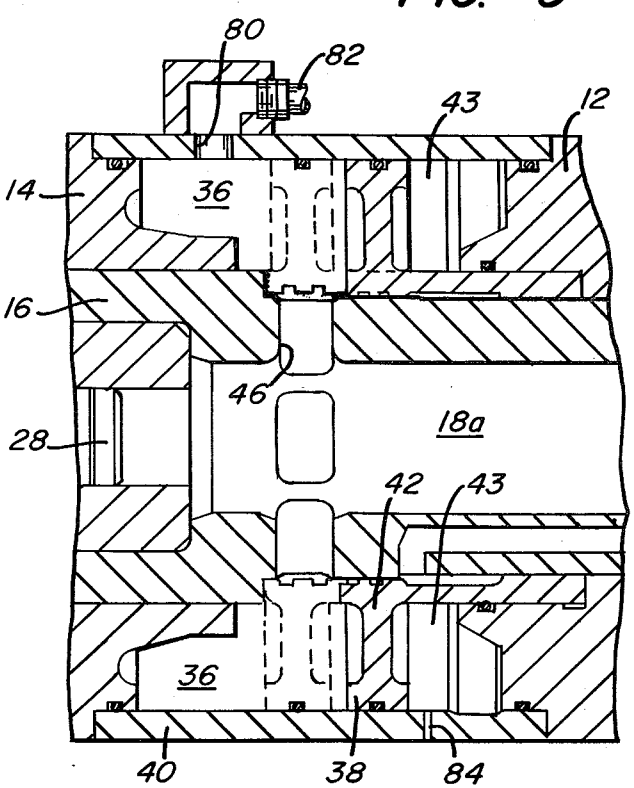
FIG. 3 is a fragmentary portion of FIG. 1 showing the main exhaust valve moved from the position shown in FIG. 1.

To provide the alternate supplying and release of hydraulic fluid pressure to the forward end of piston 20 a generally annular elongated sleeve valve 38 is disposed in circumferentially surrounding, axially slidable relationship with an intermediate portion of cylinder member 16 for opening and closing of a plurality of circumferentially spaced fluid exhaust ports 46 which penetrate cylinder 16 to provide fluid communication between forward bore portion **18*a* and an annular exhaust fluid receiving chamber 36 defined radially inwardly of a generally annular elongated shell member 40 that coaxially sealingly surrounds and extends between the respective adjacent ends of body portions 12** and 14. A radially outwardly extending member 42 connected to valve 38 (preferably a flange portion thereof) has the radially outermost extent thereof slidably sealingly engaging the inner wall of shell 40 as indicated at 44 to define a movable longitudinal end wall of exhaust chamber 36. In FIG. 1 valve 38 is shown at one extreme position thereof whereat ports 46 are closed and the volume of the exhaust chamber 36 is a minimum. In FIG. 3 valve 38 is shown at the opposite extreme position whereat ports 46 are fully open to provide open fluid communication between chamber 36 and bore portion 18*a*, and the volume of exhaust chamber 36 is a maximum.

It will be seen that flange 42 in cooperation with shell 40 and cylinder member 16 functions as a piston and cylinder means whose displacement preferably is at least substantially no less than the maximum displacement of piston 20 within bore portion 18*a* (i.e. the total volume swept by the forward end of piston 20 in moving from its full upstroke position to impact). Accordingly, the displacement volume of flange 42 within exhaust chamber 36 is large enough to receive all of the hydraulic fluid exhausted from bore portion 18*a* during each piston impact stroke. Ideally, the maximum volume of exhaust chamber 36 (FIG. 3) is preferred to be somewhat larger than the displacement of flange 42. That is, it is desired that the minimum volume of chamber 36 (FIG. 1) not be nil or substantially nil. For example, chamber 36 may have a minimum volume approximately equal to or perhaps greater than the displacement of flange 42. In a less preferred but nonetheless novel embodiment the minimum volume of chamber 36 may be only slightly larger than the displacement of flange 42 or, stated differently, the maximum volume of chamber 36 might be only slightly larger than the maximum displacement of piston 20 within bore portion 18a.

An exhaust port 80 formed in shell 40 provides fluid flow communication between chamber 36 and a fluid reservoir R by way of a conduit 82, another exhaust port 68 and a conduit means 78. A space 43 defined within shell 40 and on the opposite side of flange 42 from chamber 36 is vented by suitable vent means as indicated at 84 to preclude pressurization or rarification of air therewithin which would impede operation of valve 38.

Figure 2:
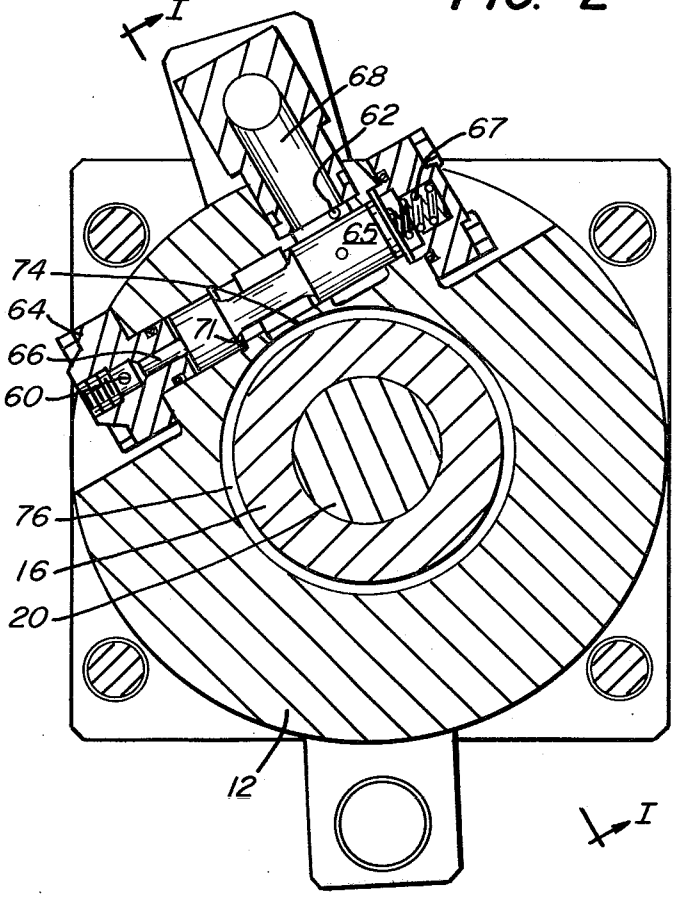
FIG. 2 is a transverse section taken on line 2—2 of FIG. 1.

Means for operation of impactor 10 include a main hydraulic fluid inlet 48 which provides for connection to impactor 10 of an external pressure fluid source such as a pump 11. Inlet 48 communicates in continuous open fluid communication with an inner, circumferentially extending undercut portion 50 of sleeve valve 38 via an axially extending fluid flow passageway means 52 formed in cylinder 16. The internal diameter of sleeve valve 38 forwardly of undercut portion 50 is larger than the internal diameter thereof rearwardly of undercut 50 and a corresponding step 54 is formed between the outer diameters of the respective peripheral portions of cylinder 16 upon which sleeve valve 38 slides to define a differential area piston between the axial ends of undercut 50. The hydraulic pressure fluid directed into undercut 50 thus exerts a continuous rearwardly directed net force on sleeve valve 38 which tends to urge the valve to its rearward or open position. Pressure fluid is also provided from inlet 48 via suitable fluid flow passageway means 56 to a trigger valve means 58 carried by backhead 30, and passageway means such as at 60, 62 are provided to communicate in fluid flow conducting relation between valve 58 and a spring biased actuator valve means 64 (FIGS. 1 and 2) which in turn communicates via a connecting passage 74 and an annular space 76 with a rearward end surface 39 of sleeve valve 38. More specifically, passage 60 supplies pressure fluid to actuate a spool portion 65 of valve 64, and passage 62 communicates between valve 58 and exhaust port 68 adjacent valve 64. Another fluid flow passage 71 communicates between a portion of inlet 48 and valve 64 to provide pressure fluid to space 76.

With piston 20 initially in the intermediate position (FIG. 1) and moving in the upstroke direction sleeve valve 38 would be in the fully forward or closed position whereat it sealingly closes exhaust ports 46 and directs pressure fluid from passageway 52 through undercut 50 and ports 46 into bore portion 18*a* to drive the piston rearwardly against the gas pressure in bore portion 18*b* thereby charging accumulator 32. Valve 38 is maintained closed by inlet fluid pressure directed from inlet 48 into space 76 via passage 71, valve 64, and passage 74 to act on a valve end surface 39. To ensure positive closure of valve 38 area 39 is made greater than the differential piston area within undercut 50.

Upon reaching its full upstroke position piston 20 actuates a forwardly protruding stem 73 of a valve plunger 70 to direct actuating pressure fluid from inlet 48 via passages 56 and 60 to an actuator port 66 of valve 64. The resultant shifting of spool 65 blocks fluid communication between passages 71 and 74, and concurrently opens fluid communication between passage 74 and exhaust port 68. Accordingly, the fluid pressure within space 76 drops to the exhaust back pressure (for example 200 psi) whereupon the continuing application of inlet fluid pressure within undercut 50 begins to open valve 38. As valve 38 opens inlet pressure is also applied to the forward end of flange 42 thus driving valve 38 to the full open position shown in FIG. 3. Chamber 36 is simultaneously enlarged by movement of flange 42 to receive the hydraulic fluid from bore portion 18*a* and the fluid pressure within the bore portion 18*a* therefore immediately becomes substantially nil as the gas pressure acting on the rearward end of piston 20 (for example 2200 psi after the piston upstroke) powers the piston to impact. As the power stroke begins piston 20 disengages plunger 70 and the plunger is returned to its normally protruding position by any suitable means, for example a mechanical spring bias element or a differential piston area between the opposite ends thereof on which the accumulator gas pressure acts. Accordingly, actuating fluid pressure to port 66 of valve 64 is relieved to exhaust by way of passage 60 valve 58, passage 62 and port 68, and spool 65 is thus returned to its normal position by a spring 67 to reestablish pressure fluid flow through passages 71 and 74 into space 76 to close valve 38.

The closing of valve 38 is delayed by any suitable time delay means to occur after the piston impact stroke is substantially completed. Such delay may be effected, for example, by the inherent time delay in multiple actuator valve operations and the relatively long fluid flow paths therebetween. As valve 38 closes, flange 42 pumps a volume of fluid equal to the displacement thereof out of chamber 36 through port 80. Fluid communication from inlet 48 by way of passage 52 to bore portion 18*a* is simultaneously reestablished to begin another piston upstroke. It is to be noted that when valve 38 has closed chamber 36 still contains a quantity of hydraulic fluid since flange 42 pumps out only an amount of fluid approximately equal to its displacement.

The remaining fluid is thought to provide a cushioning effect to cushion the inrush of hydraulic fluid into chamber 36 when valve 38 subsequently opens again.

According to the description hereinabove the present invention provides an improved fluid operable impactor having various novel features including a variable volume exhaust fluid receiving chamber and a valve means with pumping means operable during valve actuation. Notwithstanding the description hereinabove of certain preferred embodiments of the invention it is to be understood that the invention may be practiced in numerous alternative or modified embodiments without departing from the broad spirit and scope thereof. For example: the driving force for the piston impact stroke need not be provided by gas pressure but may alternatively be a mechanical spring element, liquid pressure means or other suitable drive means; the particular configuration of valve member 38 and chamber 36 may be varied within a broad latitude of suitable designs; the particular means of cycling valve 38 may be modified extensively; a check valve may be utilized in conjunction with outlet port 80 to preclude backflow of hydraulic fluid into chamber 36; and the like.

These and other embodiments and modifications having been envisioned and anticipated by the inventor, this invention should be interpreted as broadly as permitted by the scope of the claims appended hereto.

What is claimed is:

1. A fluid operable impactor assembly comprising:

a body having an elongated bore extending therein; a hammer piston axially movable within said bore to form a variable volume chamber therewithin;

an exhaust chamber adapted for fluid communication with exhaust fluid receiving means;

passageway means for fluid communication between said variable volume chamber and said exhaust chamber whereby said exhaust chamber is adapted to receive hydraulic fluid from said variable volume chamber;

valving means located intermediate said variable volume chamber and said exhaust chamber and cooperable with said passageway means to control fluid flow therethrough;

and means carried by said valving means and cooperable with said exhaust chamber for removing hydraulic fluid from said exhaust chamber only when said passageway means is open for such fluid flow.

2. The impactor assembly as claimed in claim 1 wherein said means for removing hydraulic fluid is operable to remove hydraulic fluid from said exhaust chamber by reducing the volume of said exhaust chamber.

3. The impactor assembly as claimed in claim 2 wherein said means for removing hydraulic fluid includes a movable wall portion of said exhaust chamber which moves in conjunction with said opening or closing of said passageway means by said valving means to respectively increase or reduce the volume of said exhaust chamber.

4. The impactor assembly as claimed in claim 3 wherein said valving means includes an axially slidable sleeve portion of a cylindrical valve member and said means includes a radially outwardly projecting member connected to said cylindrical valve member and forming said movable wall portion.

5. The impactor assembly as claimed in claim 1 wherein said means for removing hydraulic fluid is cooperable with said valving means for removing hydraulic fluid from said exhaust chamber only during the selective operating of said valving means to close said passageway means.

6. The impactor as claimed in claim 5 wherein said removing of hydraulic fluid from said exhaust chamber includes directing hydraulic fluid from said exhaust chamber into said exhaust fluid receiving means.

7. The impactor assembly as claimed in claim 5 wherein said means for removing hydraulic fluid is operable during each closing of said passageway means to remove from said exhaust chamber of quantity of hydraulic fluid at least equal to the quantity of hydraulic fluid to be received into said exhaust chamber from said variable volume chamber prior to the next subsequent closing of said passageway means.

8. In a fluid operable impactor assembly wherein a hammer piston is axially movably carried within an elongated bore and is reciprocable therewithin by means including fluid means for supplying hydraulic fluid into a portion of said bore to alternately displace and be displaced by said piston and exhaust fluid receiving means for receiving hydraulic fluid exhausted from said impactor assembly, the improvement comprising:

said exhaust fluid receiving means including a variable volume exhaust chamber maintained in intermittent fluid communication with said portion of said bore and having a minimum volume and a maximum volume wherein the differential volume between said minimum and said maximum volumes is substantially no less than the displacement of said piston within said portion of said bore.

9. The improvement claimed in claim 8 additionally comprising valving means cooperable with said exhaust chamber to provide said intermittent fluid communication.

10. The improvement as claimed in claim 9 wherein the vlume of said exhaust chamber is reduced from said maximum volume to said minimum volume in conjunction with the closing of said valving means to interrupt said fluid communication.

11. The improvement as claimed in claim 10 wherein said exhaust chamber is maintained in fluid flow communication with other portions of said exhaust fluid receiving means.

12. The improvement as claimed in claim 8 wherein said minimum volume is substantially no less than said differential volume.

13. The improvement as claimed in claim 8 wherein said exhaust chamber is maintained at said maximum volume substantially throughout the displacement of hydraulic fluid from said portion of said bore by said piston and at said minimum volume substantially throughout the displacing of said piston within said bore by hydraulic fluid.

14. In an impacting assembly in which a hammer piston is reciprocably movable through alternate work strokes and return strokes within an elongated bore of a body member with the return strokes being effected by hydraulic fluid which is selectively supplied to a variable volume return chamber formed in the bore in conjunction with one axial end of the hammer piston and the work strokes being effected by a drive system operable to accelerate the hammer piston in an axial direction to decrease the volume of the variable volume chamber, and wherein a valve means includes a movable valve member which is selectively movable to a first position to permit the supplying of hydraulic fluid to the variable volume chamber to effect a return stroke and subsequently to a second position to permit an exhaust fluid receiving chamber in the body member to receive hydraulic fluid from the variable volume chamber thereby permitting the drive system to effect a work stroke, the improvement comprising: integral means carried by said valve member and movable therewith to discharge hydraulic fluid from said exhaust fluid receiving chamber during movement of said valve member from said second to said first position.

15. The improvement as claimed in claim 14, wherein said integral means is cooperable with said exhaust fluid receiving chamber to effect a reduction of the volume of said exhaust fluid receiving chamber to provide said discharging of hydraulic fluid therefrom.

16. The improvement as claimed in claim 15 wherein the magnitude of the reduction of volume of said exhaust fluid receiving chamber is substantially no less than the decrease in volume of said variable volume chamber during a single work stroke.

17. The improvement as claimed in claim 15 wherein said exhaust fluid receiving chamber includes a cylinder means and said integral means includes a piston means cooperably received within said cylinder means and movable therewithin to effect said reduction of volume of said exhaust fluid receiving chamber.

18. The improvement as claimed in claim 17 wherein the displacement of said piston means within said cylinder means effects said reduction of volume of said exhaust fluid receiving chamber.

19. The improvement as claimed in claim 17 wherein said exhaust fluid receiving chamber communicates with an exhaust fluid reservoir means which receives the hydraulic fluid discharged from said exhaust fluid receiving chamber.

20. The improvement as claimed in claim 19 wherein the cooperation of said piston means with said cylinder means defines a second variable volume chamber isolated from said exhaust fluid receiving chamber by said piston means and communicating with said exhaust fluid reservoir means.

21. The improvement as claimed in claim 14 additionally including fluid passageway means in said valve means cooperable with a hydraulic fluid supply system to supply hydraulic fluid to said variable volume chamber when said valve member is in said first position.

22. The improvement as claimed in claim 21 wherein said hydraulic fluid supply system includes said exhaust fluid reservoir means.

* * * * *

UNITED STATES PATENT OFFICE

CERTIFICATE OF CORRECTION

PATENT NO. : 4,150,603

DATED : April 24, 1979

INVENTOR(S) : M. Etherington and D. Roberts

It is certified that error appears in the above-identified patent and that said Letters Patent are hereby corrected as shown below:

Claim 4, line 4, the words --for removing hydraulic fluid-- are to be inserted directly after "means".

Claim 10, line 2, "Vlume" is to be corrected to --volume--.

Signed and Sealed this

*Seventeenth* Day of *July 1979*

[SEAL]

*Attest:*

*Attesting Officer*

LUTRELLE F. PARKER

*Acting Commissioner of Patents and Trademarks*